US007608150B2

(12) United States Patent
Park et al.

(10) Patent No.: US 7,608,150 B2
(45) Date of Patent: Oct. 27, 2009

(54) COATING APPARATUS AND OPERATING METHOD THEREOF

(75) Inventors: Jeong Kweon Park, Gumi-si (KR); Seung Bum Lee, Seoul (KR); Sang Hyoung Jin, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 366 days.

(21) Appl. No.: 11/453,869

(22) Filed: Jun. 16, 2006

(65) Prior Publication Data

US 2007/0020401 A1 Jan. 25, 2007

(30) Foreign Application Priority Data

Jun. 30, 2005 (KR) ..... 10-2005-0058002

(51) Int. Cl.
*B05C 5/02* (2006.01)

(52) U.S. Cl. ..... 118/663; 118/664; 118/665; 118/670; 118/688; 118/708; 118/712; 118/302; 134/113; 134/104.1

(58) Field of Classification Search ..... 118/663, 118/664, 665, 670, 688, 708, 712, 302, 52, 118/319, 320; 134/113, 104.1; 356/237.3, 356/237.4, 237.5
See application file for complete search history.

(56) References Cited

U.S. PATENT DOCUMENTS 5,849,084 A * 12/1998 Hayes et al. ..... 118/320
5,865,901 A * 2/1999 Yin et al. ..... 134/2
6,092,937 A * 7/2000 Snodgrass et al. ..... 396/611
6,268,013 B1 * 7/2001 Akimoto et al. ..... 427/8
6,780,734 B2 * 8/2004 Kim et al. ..... 438/464
7,097,714 B2 * 8/2006 Hackenberg ..... 134/21

FOREIGN PATENT DOCUMENTS

| | | |
|---|---|---|
| JP | 2001-009341 | 1/2001 |
| JP | 2004-336070 | 11/2004 |
| JP | 2005-052821 | 3/2005 |

* cited by examiner

*Primary Examiner*—Laura Edwards
(74) *Attorney, Agent, or Firm*—McKenna Long & Aldridge

(57) ABSTRACT

A coating apparatus and an operating method thereof that prevent damage to the nozzle of a spinless coater from impurities on a substrate during resin coating of the substrate, and impurities remaining on a stage at the bottom of the substrate. The coating apparatus comprises a stage, a nozzle, a nozzle cleaner, and a stage cleaner. A substrate is placed upon the stage. The nozzle discharges resin on the substrate to perform coating. The nozzle cleaner cleans the nozzle. The stage cleaner cleans the stage. The operating method includes removing a coated first substrate from atop a stage, cleaning the stage using a stage cleaner, introducing a second substrate to be coated onto the cleaned stage, and discharging resin through a nozzle onto the second substrate and coating the second substrate.

6 Claims, 6 Drawing Sheets

COATING APPARATUS AND OPERATING METHOD THEREOF

This application claims the benefit of Korean Patent Application No. 10-2005-0058002, filed on Jun. 30, 2005, which is hereby incorporated by reference for all purposes as if fully set forth herein.

BACKGROUND OF THE INVENTION

1. Field of the Invention

The present invention relates to a coating apparatus, and more particularly, to a coating apparatus and an operating method thereof that prevent damage to the nozzle of the coating apparatus resulting from impurities on a substrate during resin coating of the substrate, and impurities remaining on a stage at the bottom of the substrate. This especially applies to a spinless coater for coating resin, but may apply to other coaters and other nozzles.

2. Discussion of the Related Art

Recently, the demand for flat panel displays with low profiles, small sizes, low power consumption, and other favorable characteristics, has increased. Of these, liquid crystal display devices (LCDs) with high quality color reproduction are actively being developed.

LCDs have two substrates with electrodes formed on each side thereof, and the sides with the electrodes face one another. Then, a liquid crystal substance is injected between the two substrates. A voltage is supplied to the two electrodes which creates an electromagnetic field that moves the liquid crystal molecules and thus changes the degree of light transmission. An image is thus created.

A lower (array) LCD substrate may include a thin film transistor for applying a pixel electrode signal. This thin film transistor may be formed with a metal layer and an insulating layer through repeated photolithography. The upper substrate of the LCD may include a color filter having colors of red (R), green (G), and blue (B).

FIG. 1 is a schematic view of an LCD structure according to the related art.

Referring to FIG. 1, an LCD according to the related art has a TFT substrate with a TFT array formed thereon, a color filter substrate with a color filter arranged thereon, and liquid crystal filled between the TFT substrate and the color filter substrate, and a back light assembly for supplying light in order to display an image.

The TFT array formed on the TFT substrate relays and controls electrical signals and the liquid crystal controls the amount of light transmitted by altering its molecular arrangement according to an applied voltage. Through this process, controlled light is transmitted through the color filter substrate to display desired colors and images.

When manufacturing the above LCD, the color filter substrate and TFT substrate have a sealing material interposed between them. The sealing material combines the color filter substrate and the TFT substrate, and also acts as a sealant to prevent liquid crystal, injected between the color filter and TFT substrates, from leaking.

Referring to FIGS. 2 and 3, a brief description of the process of coating resin to form the color filter on the color filter substrate will be given. FIG. 2 is a schematic view of the structure of a coating apparatus according to the related art, and FIG. 3 is a perspective view showing a process for coating resin on a color filter substrate performed with a coating apparatus according to the related art.

As shown in FIG. 2, a coating apparatus according to the related art includes a nozzle 207 for discharging resin, and a nozzle support 205 for supporting and moving the nozzle 207. The nozzle support 205 moves along a rail 201, and the nozzle 207 discharges resin onto a substrate 209 (glass, for example) disposed above a stage 203 to form a color filter. Here, the rail 201 may be an air slider rail.

In the coating apparatus according to the related art of FIG. 3, when the nozzle 207 discharges resin onto the substrate 209, tracking sensors 301*a* and 301*b* determine whether the nozzle 207 is properly aligned and properly moving over the substrate 209. Here, the tracking sensors 301*a* and 301*b* measure a gap between the nozzle 207 and the substrate 209 to determine whether the nozzle 207 deviates from above the substrate 209.

In the process of coating resin on the substrate 209, impurities that resulted from a previous process may be present on the substrate 209. A normal gap between the substrate 209 and the nozzle 207 is about 150 μm, and an impurity such as a particle of glass may be several millimeters. Accordingly, when impurities remain on the substrate 209 during the coating process, the nozzle 207, which is costly, that discharges resin onto the substrate 209 may be damaged.

Furthermore, if an impurity 403 is present on the stage 203 on which the substrate 209 is placed, the problem as illustrated in FIG. 4 occurs. FIG. 4 is a diagram showing a defect that occurs when resin is coated on a substrate 209 while an impurity 403 remains on a stage 203 in a coating apparatus according to the related art. Specifically, when an impurity 403 remains on the stage 203, the impurity 403 is located near the rear surface of the substrate 209, thus producing a defect during the resin coating process.

SUMMARY OF THE INVENTION

Accordingly, the present invention is directed to a coating apparatus and operating method thereof that substantially obviates one or more of the problems due to limitations and disadvantages of the related art.

An advantage of the present invention is to provide a coating apparatus and an operating method thereof that prevent damage to a spinless coater nozzle for coating resin on a substrate.

Additional features and advantages of the invention will be set forth in the description which follows, and in part will be apparent from the description, or may be learned by practice of the invention. These and other advantages of the invention may be realized and attained by the structure particularly pointed out in the written description and claims hereof as well as the appended drawings.

To achieve these and other advantages and in accordance with the purpose of the present invention, as embodied and broadly described, there is provided a coating apparatus comprising: a stage on which a substrate is placed; a nozzle for discharging resin on said substrate to perform coating; a nozzle cleaner for cleaning said nozzle; and a stage cleaner for cleaning said stage.

In another aspect of the present invention, there is provided an operating method of a coating apparatus comprising: removing a coated first substrate from atop a stage; cleaning said stage using a stage cleaner; introducing a second substrate to be coated onto said cleaned stage; and discharging resin through a nozzle onto said second substrate and coating the second substrate.

The spinless coating apparatus for coating resin and the operating method thereof according to the present invention prevent damage to the nozzle of a spinless coater where damage results from impurities on a substrate during resin coating of the substrate, and impurities remaining on a stage at the bottom of the substrate.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, example of which is illustrated in the accompanying drawings. Wherever possible, the same reference numbers will be used throughout the drawings to refer to the same or like parts.

Figure 1:
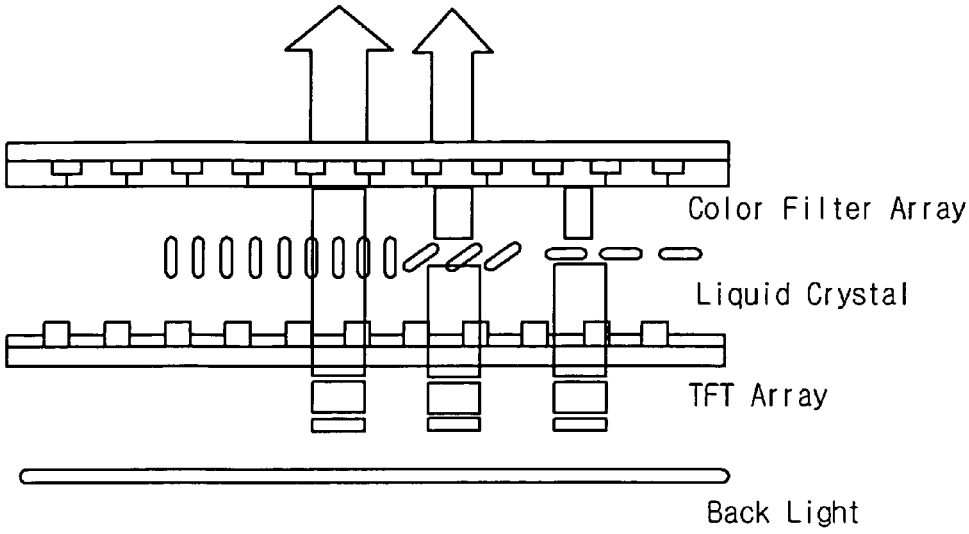
Fig. 1 RELATED ART
FIG. 1 is a schematic view of an LCD structure according to the related art.
Figure 2:
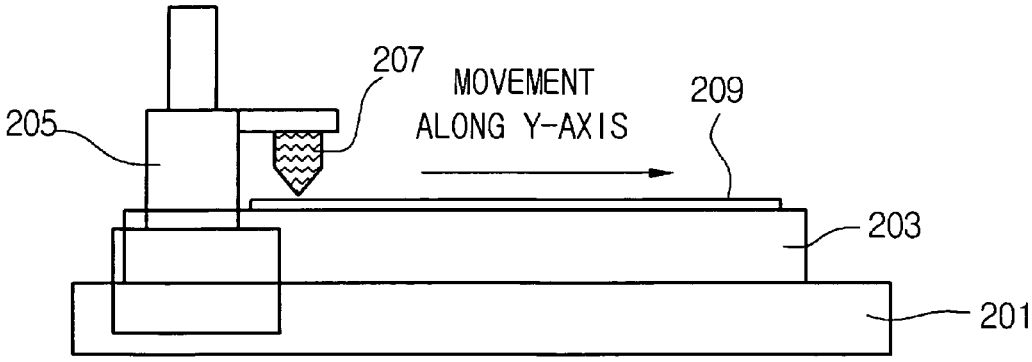
Fig. 2 RELATED ART
FIG. 2 is a schematic view of the structure of a coating apparatus according to the related art.
Figure 3:
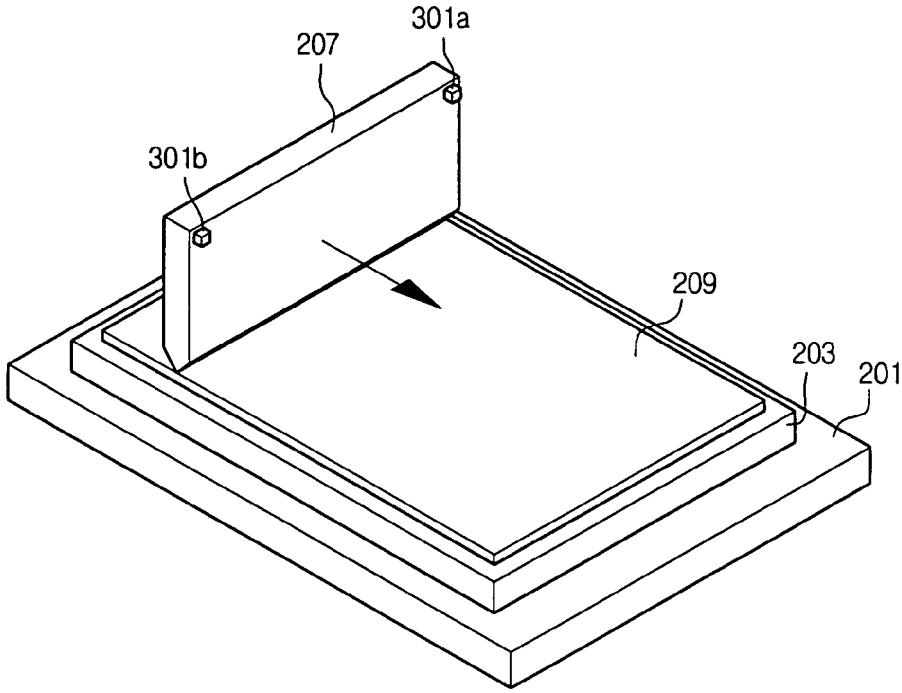
Fig. 3 RELATED ART
FIG. 3 is a perspective view showing a process for coating resin on a color filter substrate performed with a coating apparatus according to the related art.
Figure 4:
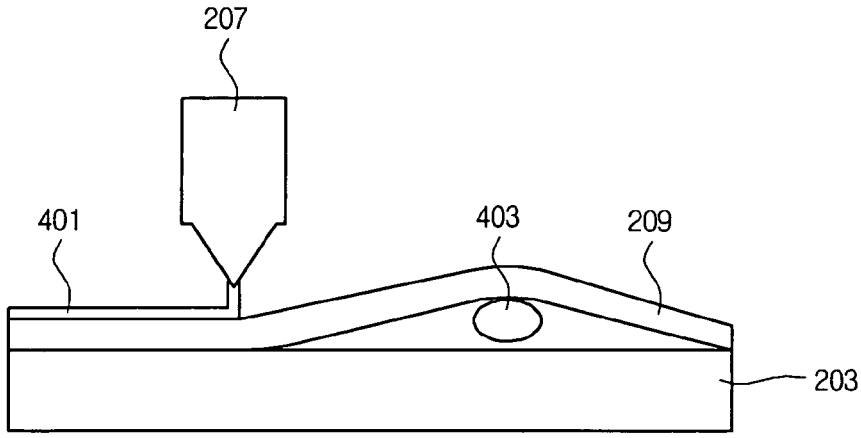
Fig. 4 RELATED ART
FIG. 4 is a diagram showing a defect that occurs when resin is coated on a substrate while an impurity remains on a stage in a coating apparatus according to the related art.
Figure 5:
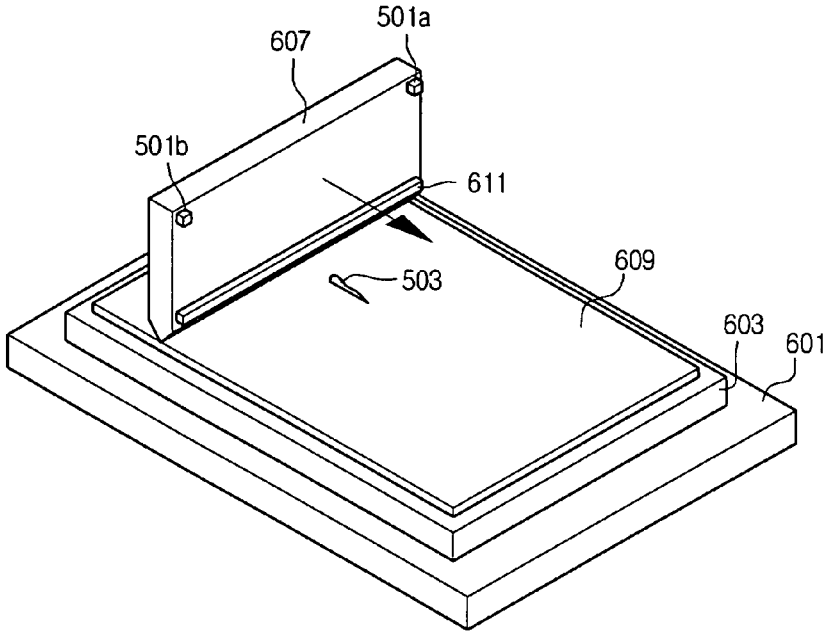
FIG. 5 is a perspective view showing the detection of an impurity on a substrate during a process for coating resin on the substrate performed with a coating apparatus according to the present invention.

FIG. 5 is a perspective view showing the detection of an impurity on a substrate during a process for coating resin on the substrate performed with a coating apparatus according to the present invention.

Referring to FIG. 5, the coating apparatus according to the present invention includes a rail 601, a stage 603, a nozzle 607, tracking sensors 501*a* and 501*b*, and a scanner 611.

The nozzle 607 discharges resin to coat a substrate 609 placed on the stage 603. The tracking sensors 501*a* and 501*b* detect the moving path of the nozzle 607, and determine whether the nozzle 607 deviates from above the substrate 609. The scanner 611 is provided at the front of the nozzle 607, and scans the upper region of the substrate 609 for the presence of impurities in the direction in which the nozzle 607 moves. The coating apparatus according to the present invention also includes a control unit (not shown) that refers to data provided by the tracking sensors 501*a* and 501*b* and the scanner 611, and controls the operation of the nozzle 607 accordingly.

The coating apparatus according to the present invention further includes a nozzle support (not shown) for supporting the nozzle 607. The nozzle support moves along the rail 601, and the nozzle 607 discharges resin onto a substrate 609 (glass, for example) placed on the stage 603, to form a color filter. Here, the rail 601 may be an air slider rail.

The coating apparatus according to the present invention uses the tracking sensors 501*a* and 501*b* to determine whether the nozzle 607 is properly aligned and moving over the substrate 609 during the discharging of resin through the nozzle 607. Here, the tracking sensors 501*a* and 501*b* measure a gap between the nozzle 607 and the substrate 609 to determine whether the nozzle 607 has deviated from above the substrate 609.

The coating apparatus according to the present invention also uses the scanner 611 to detect the presence of impurities on the substrate 609 while resin is discharged through the nozzle 607 onto the substrate 609. Here, the scanner 611 is formed to protrude from the front of the nozzle 607 along the entire length of the nozzle 607, and moves in unison with the nozzle 607. Thus, the scanner 611 is able to detect the presence of an impurity 503 along the moving direction of the nozzle 607. Here, the scanner 611 may employ various image processing methods to detect the presence of the impurity 503, for example, using a pattern detector to compare one pixel image with adjacent pixel images to determine if an impurity 503 is present.

Therefore, when the presence of the impurity 503 is detected ahead of the nozzle 607, the coating apparatus according to the present invention stops the operation of the nozzle 607, thus preventing damage to the nozzle 607 potentially caused by the impurity 503.

Figure 6:
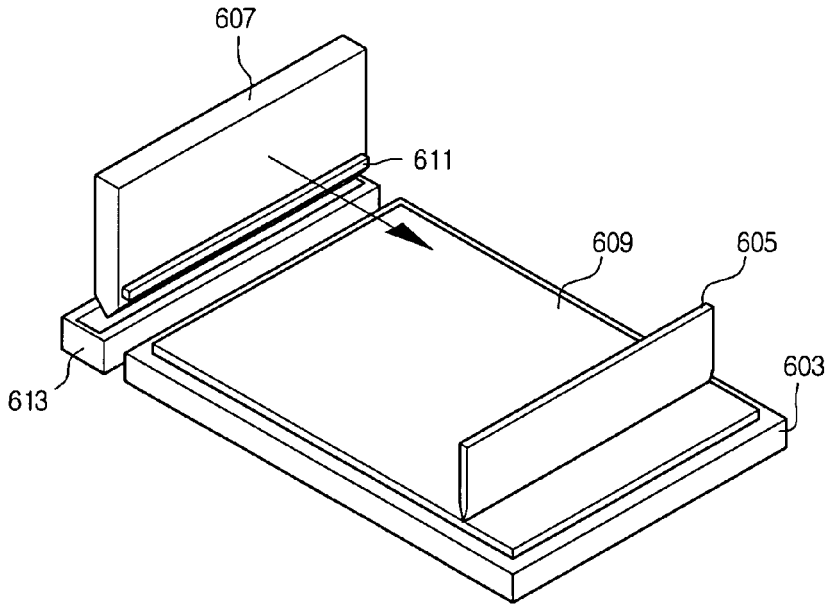
FIGS. 6, 7 and 8 are perspective views showing a process for removing impurities from the top of a stage and coating resin on a substrate performed with a coating apparatus according to the present invention.
Figure 7:
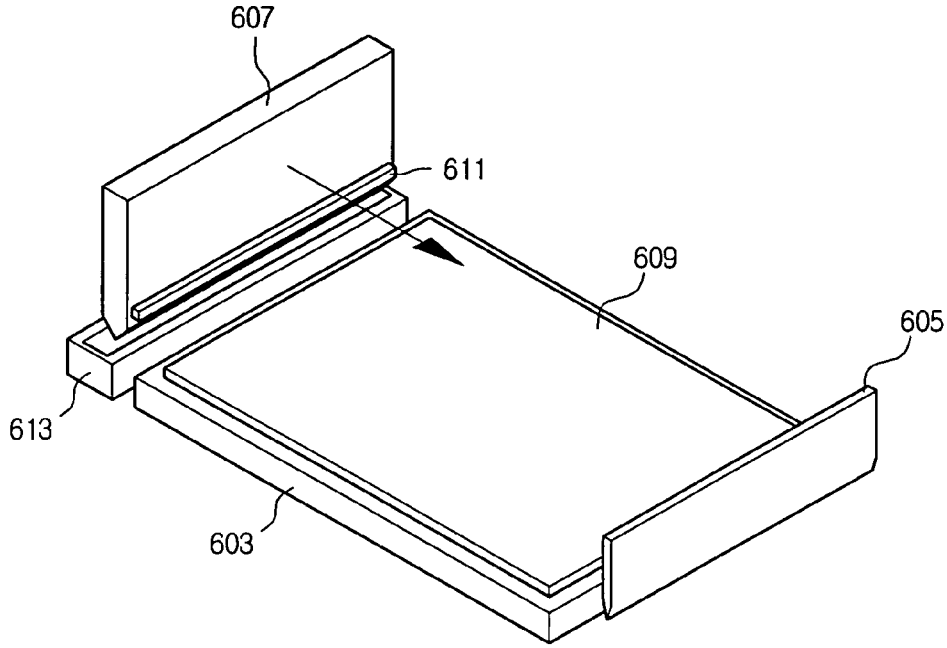
Figure 8:
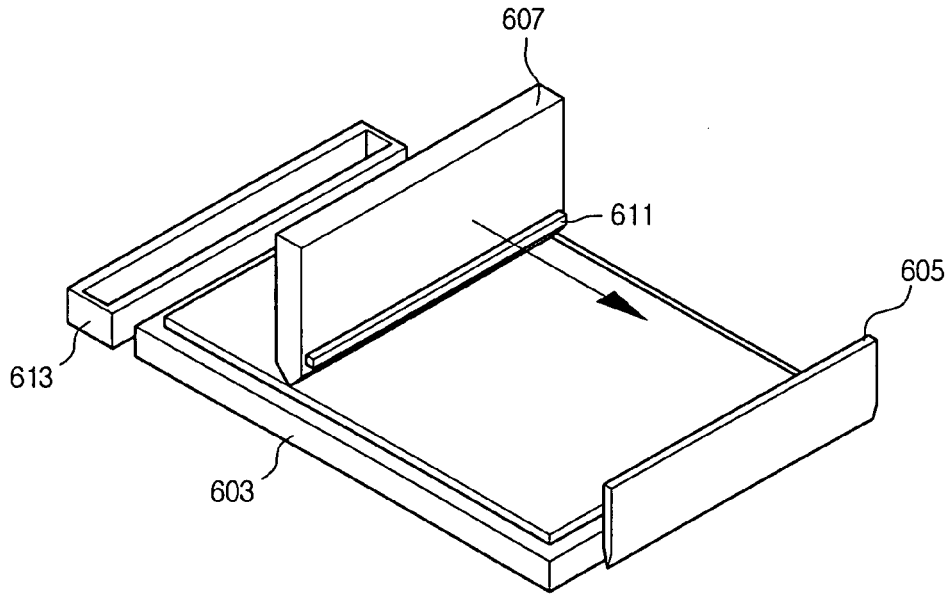

In order to prevent the presence of impurities on the stage, a method for cleaning the stage is shown in FIGS. 6, 7 and 8. FIGS. 6, 7 and 8 are perspective views showing a process for removing impurities from the top of a stage and coating resin on a substrate performed with a coating apparatus according to the present invention.

Referring to FIG. 6, a coating apparatus according to the present invention includes a stage cleaner 605 and a nozzle cleaner 613. The stage cleaner 605 is provided for cleaning the stage 603, and the nozzle cleaner 613 is provided for cleaning the nozzle 607.

The above-structured coating apparatus performs cleaning of the stage 603 and the nozzle 607 in the process outlined below, and performs coating of a mounted substrate.

When a first substrate 609 that has been coated on the stage 603 is removed, the stage cleaner 605 moves back and forth over the stage 603, cleaning the stage 603, as shown in FIG. 6.

Here, the cleaning of the stage 603 may be performed after each substrate has been coated thereon and removed, or after a preset number of substrates have been coated and removed. While the cleaning of the stage 603 is being performed, cleaning of the nozzle 607 by the nozzle cleaner 613 is also performed.

When the above process of cleaning the nozzle 607 and the stage 603 is completed, a substrate 609 to be coated is introduced and positioned on the cleaned stage 603, as shown in FIG. 7. Next, the nozzle 607 performs coating by moving and discharging resin onto the substrate 609, as shown in FIG. 8. Through the above cleaning process, impurities are kept off of the nozzle 607 and the stage 603.

Figure 9:
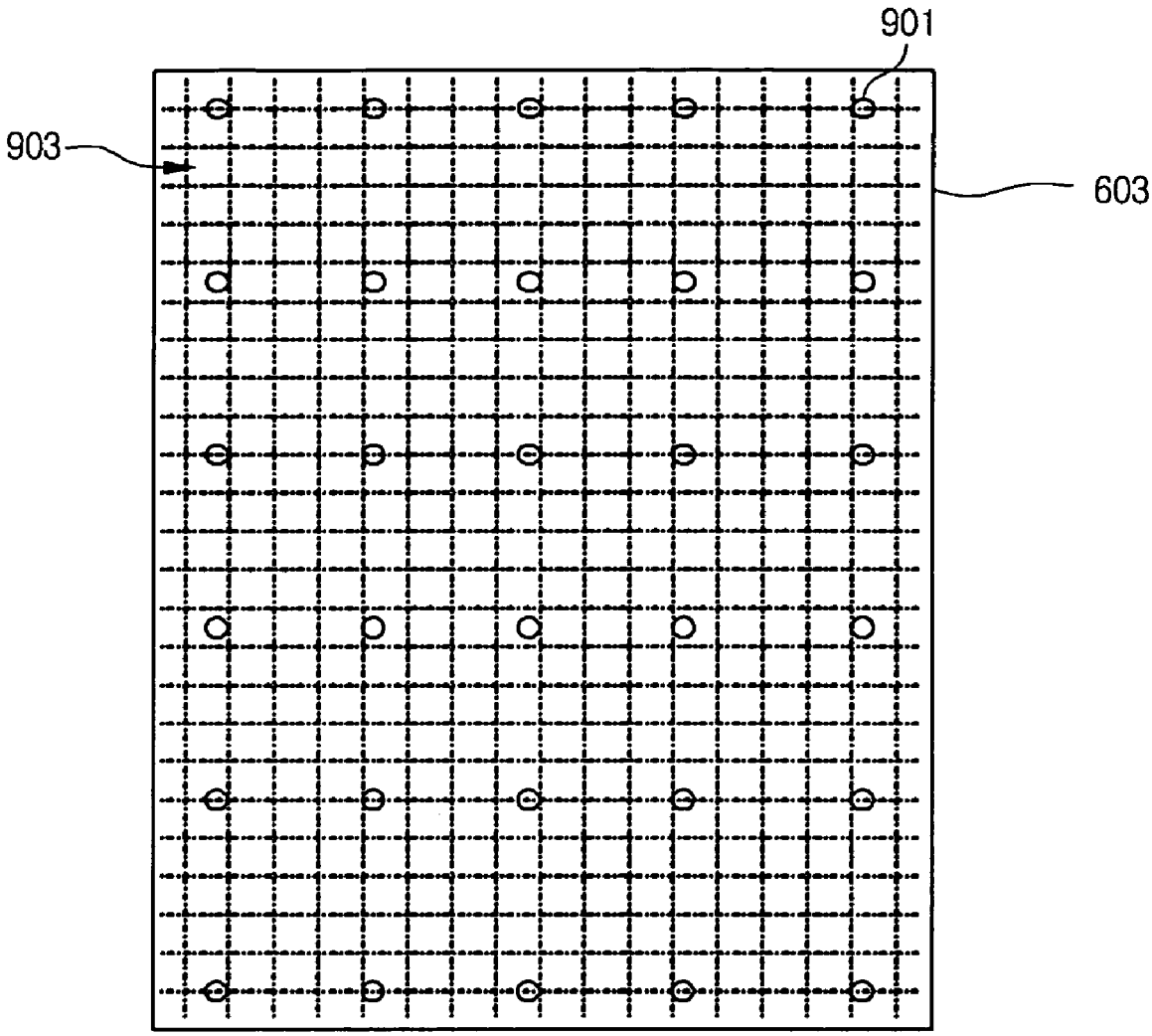
FIG. 9 is a detailed view of a stage of a coating apparatus according to the present invention.

The structure of the stage and the stage cleaner according to the present invention will now be described in detail with reference to FIGS. 9 and 10. FIG. 9 is a detailed view of a stage of a coating apparatus according to the present invention, and FIG. 10 is a detailed view of the structure of a stage cleaner in a coating apparatus of the present invention.

A stage 603 of a coating apparatus according to the present invention includes a lift pin 901 and small apertures 903. The lift pin 901 is used to support an introduced substrate or in the removal of a substrate that has been coated. For example, the lift pin 901 may rise and receive a substrate from robotic arms, and descend to position the substrate on the stage 603. When the coating process is completed, the lift pin 901 may rise again to lift the substrate up to be received by the robotic arm.

The small apertures 903 are formed roughly in a grid on the stage 603 to suction and fix an introduced substrate on the stage 603. By forming a vacuum through the small apertures 903, the substrate can be suctioned and securely fixed. The small apertures may be formed in any appropriate pattern.

Figure 10:
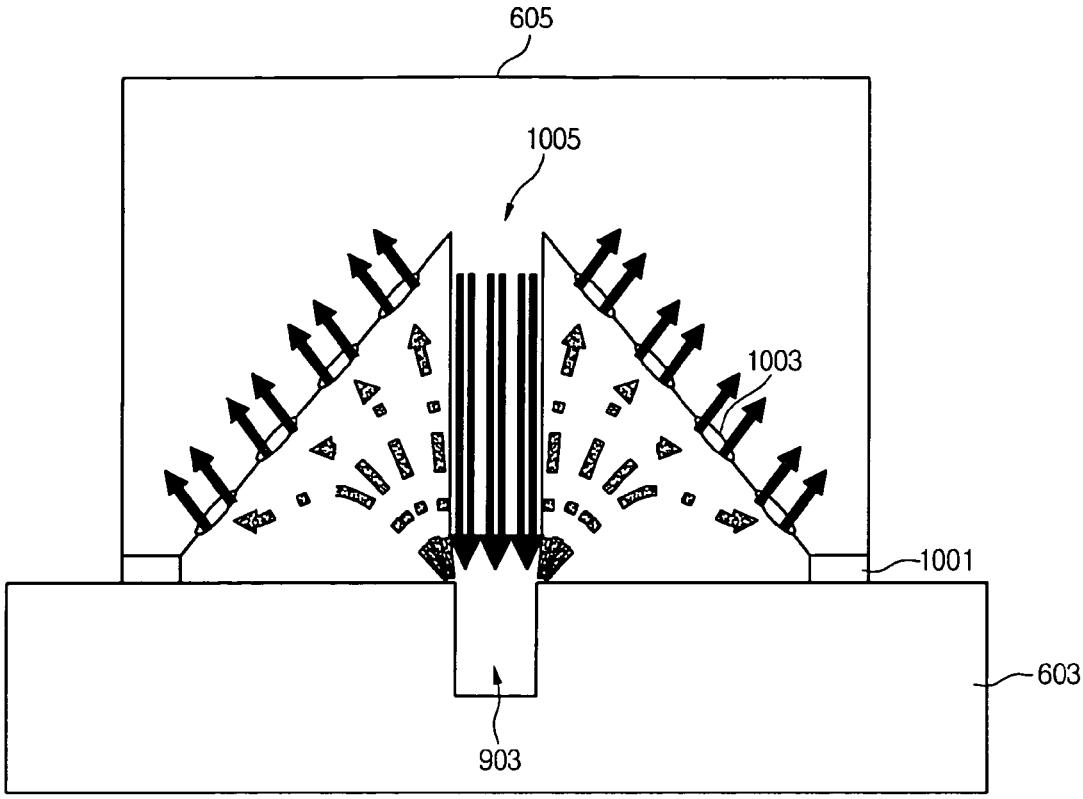
FIG. 10 is a detailed view of the structure of a stage cleaner in a coating apparatus according to the present invention.

The stage cleaner 605 of the coating apparatus according to the present invention may include a contacting member 1001, a suctioning portion 1003, and a clean dry air (CDA) discharger 1005 as illustrated in FIG. 10.

As shown in FIG. 10, the contacting member 1001 is formed to contact the stage 603 and remove impurities from the surface of the stage 603 while the stage cleaner 605 moves back and forth thereon. The contacting member 1001 may be formed of a polymer.

The impurities removed from the stage 603 by the contacting member 1001 pass through the suctioning portion 1003 formed in the stage cleaner 605 and are expelled to the outside. To smoothly perform this process, the stage cleaner 605, according to the present invention, includes the CDA discharger 1005. In the stage cleaner 605 according to the present invention, the contacting member 1001 moves impurities stuck on the stage 603, and the clean dry air discharged by the CDA discharger 1005 suspends the impurities, whereupon they are suctioned through the suctioning portion 1003 to the outside. Here, by creating a vacuum in the suctioning portion 1003, the impurities on the stage 603 can be completely removed to the outside.

Accordingly, the presence of impurities on the stage 603 can be prevented, so that defects caused by impurities on the rear surface of a substrate (or the upper surface of the stage) can be prevented.

The above-described coating apparatus and operating method thereof according to the present invention prevent damage to the nozzle of a spinless coater for coating resin, such damage resulting from impurities on a substrate during resin coating of the substrate, and impurities remaining on a stage at the bottom of the substrate.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A coating apparatus comprising:

a stage on which a substrate is placed;

a nozzle for discharging resin on said substrate to perform coating;

a nozzle cleaner for cleaning said nozzle;

a stage cleaner for cleaning said stage;

at least a tracking sensor for detecting a moving path of the nozzle and whether the nozzle deviates from above the substrate; and a scanner provided near a front end of the nozzle, for scanning an upper region of the substrate along a moving direction of the nozzle to determine the presence of impurities, wherein the scanner protrudes from a front surface of the nozzle and has a length about equal to a length of the nozzle.

2. The coating apparatus according to claim 1, wherein the stage cleaner includes a contacting member for contacting the stage, a CDA (clean dry air) discharger for discharging CDA, and a suctioning portion for suctioning impurities on the stage.

3. The coating apparatus according to claim 2, wherein the contacting member is formed of a polymer.

4. The coating apparatus according to claim 1, wherein the stage includes small apertures substantially in a grid pattern thereon for vacuum suctioning.

5. The coating apparatus of claim 4, wherein the stage further includes a lift pin for support or removal of a coated substrate.

6. The coating apparatus according to claim 1, wherein the tracking sensor measures a gap between the nozzle and the substrate to determine whether the nozzle deviates from above the substrate.

* * * * *